US005102142A

United States Patent [19]

Bittl

[11] Patent Number: 5,102,142

[45] Date of Patent: Apr. 7, 1992

[54] GOLF PUTTING TRAINING DEVICE

[76] Inventor: Douglas J. Bittl, 1020 E. Lyon, Milwaukee, Wis. 53202

[21] Appl. No.: 680,731

[22] Filed: Apr. 5, 1991

[51] Int. Cl.[5] ..... A63B 69/36; A63B 21/12

[52] U.S. Cl. ..... 273/183 B; 273/192; 273/189 R; 482/109; 482/139

[58] Field of Search ..... 273/191 R, 191 A, 191 B, 273/191 C, 192, 183 B, 186 R, 186 A, 186 C, 188 R, 189 R, 188 A, 190 R; 272/143, 139, 135, 136, 137, 138, 134, 124, 118; 434/252

[56] References Cited

U.S. PATENT DOCUMENTS 3,415,524 12/1968 Vickers ..... 273/189 R
3,767,204 10/1973 Bryson ..... 273/183 B
3,971,255 7/1976 Varney et al. ..... 272/143 X
4,333,644 6/1982 Lambert et al. ..... 272/118
4,773,398 9/1988 Tatom ..... 272/143 X
4,781,372 11/1988 McCormack ..... 272/118 X

*Primary Examiner*—George J. Marlo
*Attorney, Agent, or Firm*—James L. Kirschnik

[57] ABSTRACT

A golf putting training device includes a guided, longitudinally movable carriage assembly supported in an upper horizontal frame. The carriage includes guide members for engaging the forearms of a golfer during putting to assist him in developing a putting stroke which is straight and true along the path of intended travel of the putt. The movable carriage assembly is also adjustable to enlarge the space between the guide members, and the guides may also be adjusted transversely to suit the users natural putting address position. The frame is supported on vertical legs and is adjustable upwardly or downwardly to suit the individual golfer.

11 Claims, 2 Drawing Sheets 10
11
12
13
13
14
14
15
16
16
17
17
17
22
23
27
28
29
30
35
35
42
43
46
49
50
50
51
58

GOLF PUTTING TRAINING DEVICE

. Field of the Invention

The present invention relates to a device for training golfers in developing their putting strokes.

2. Description of the Prior Art

Numerous attempts have been made to provide devices to assist golfers in developing their putting strokes. The goal of such devices is typically to aid the golfer in developing a stroke which will result in a straight path of travel of the putter head. One approach to achieve this goal is found in devices which provide parallel walls or tracks in which the putting head is placed and forced to travel. One example of such a device is found in U.S. Pat. No. 3,685,883 to Jack, Jr. issued Aug. 22, 1972 where an alarm is sounded if the putting head contacts channel sidewalls paralleling the path of intended club movement. Similarly variations of adjustable parallel pathways are found in U.S. Pat. No. 4,230,319 to Lindner issued Oct. 28, 1980, U.S. Pat. No. 4,423,875 to Miller issued Jan. 3, 1984, and U.S. Pat. No. 4,544,160 to Miner issued Oct. 1, 1985. Finally, a curved putting track is shown in U.S. Pat. No. 4,437,669 to Pelz issued Mar. 20, 1984. A drawback to these devices is that the user's conscious effort is directed to keeping the putter between the confines of the device rather than to the outcome of the putt or the development of "feel" for the putter head, which my invention allows the user to accomplish.

A number of other putting devices utilize the concept of gripping or guiding the putter shaft along a defined pathway. Examples of such devices are found in U.S. Pat. No. 3,685,835 to Fahy issued Aug. 22, 1972, U.S. Pat. No. 4,133,535 to Marsh issued Jan. 9, 1979, and U.S. Pat. No. 4,334,684 to Sterling issued June 15, 1982. A major disadvantage of these devices for developing putting strokes is that by restricting or confining the path of travel of either the putting head or the shaft of the putter itself, a golfer cannot effectively develop a "feel" for the putter head and does not know if he has made a true putt independent of the device itself.

SUMMARY OF THE INVENTION

An object of the invention is to provide a training device for putting which does not physically restrain or confine the putter club head or putter shaft during putting.

Another object of the invention is to provide a device which aids a golfer during his putting stroke by guiding the path of movement of the golfer's arms during the putting stroke so the user can develop the proper muscle memory, a recognized golf training method. The arm guides are adjustable to suit the user's natural address position.

Another object of the invention is to guide the arms on a true putting line, without conscious effort, so the user is able to concentrate on developing a sense of "feel" for the putter head.

The objects of the invention are accomplished by providing a traveling carriage which is movable along a predefined path along a supporting frame. The carriage includes guide members which are positioned to contact the forearms of a golfer while addressing a golf ball for a putt. The guide members and path of movement of the carriage restrict the path of travel of the golfer's arms during putting while permitting the putter club to move and be gripped without restraint.

DESCRIPTION OF A PREFERRED EMBODIMENT

Figure 1:
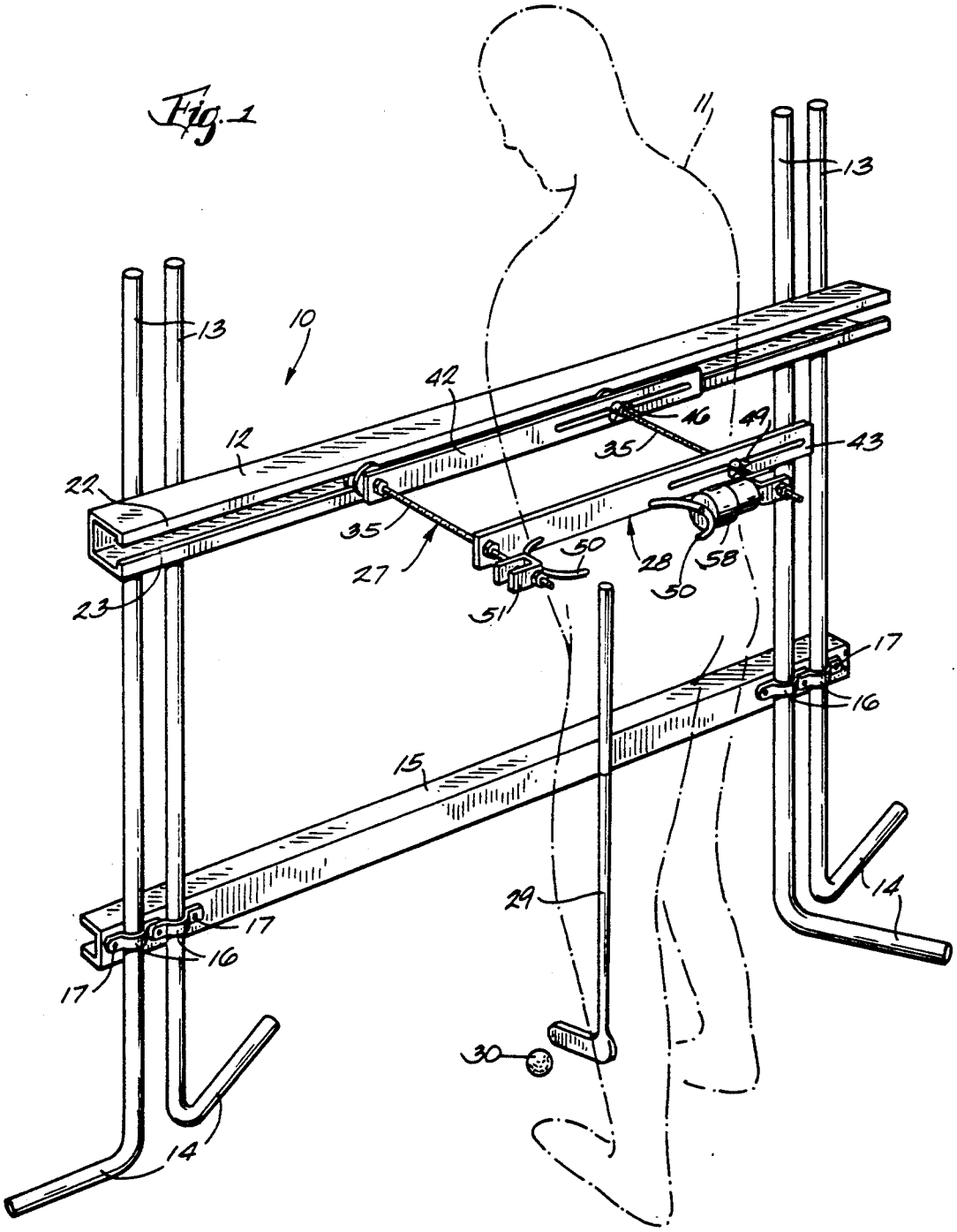
FIG. 1 is a perspective view of the device according to the invention with an outline of a golfer in position for its use.

Referring to FIG. 1, a putting training device 10 according to the invention is shown with a phantom outline of a golfer 11 positioned to use it. The device 10 generally consists of an elongated upper frame 12 supported at its ends by vertical legs 13 having horizontal support feet 14. The frame 12 is positioned at approximately waist level, and to provide further stability to the device 10, a longitudinally extending lower frame 15 is provided below the frame 12 and above the bottom of the legs 13. The upper and lower frames 12 and 15 are secured to the legs 13 in any suitable fashion such as the use of clamps 16 and screws 17.

Figures 2, 3, 4, 5:
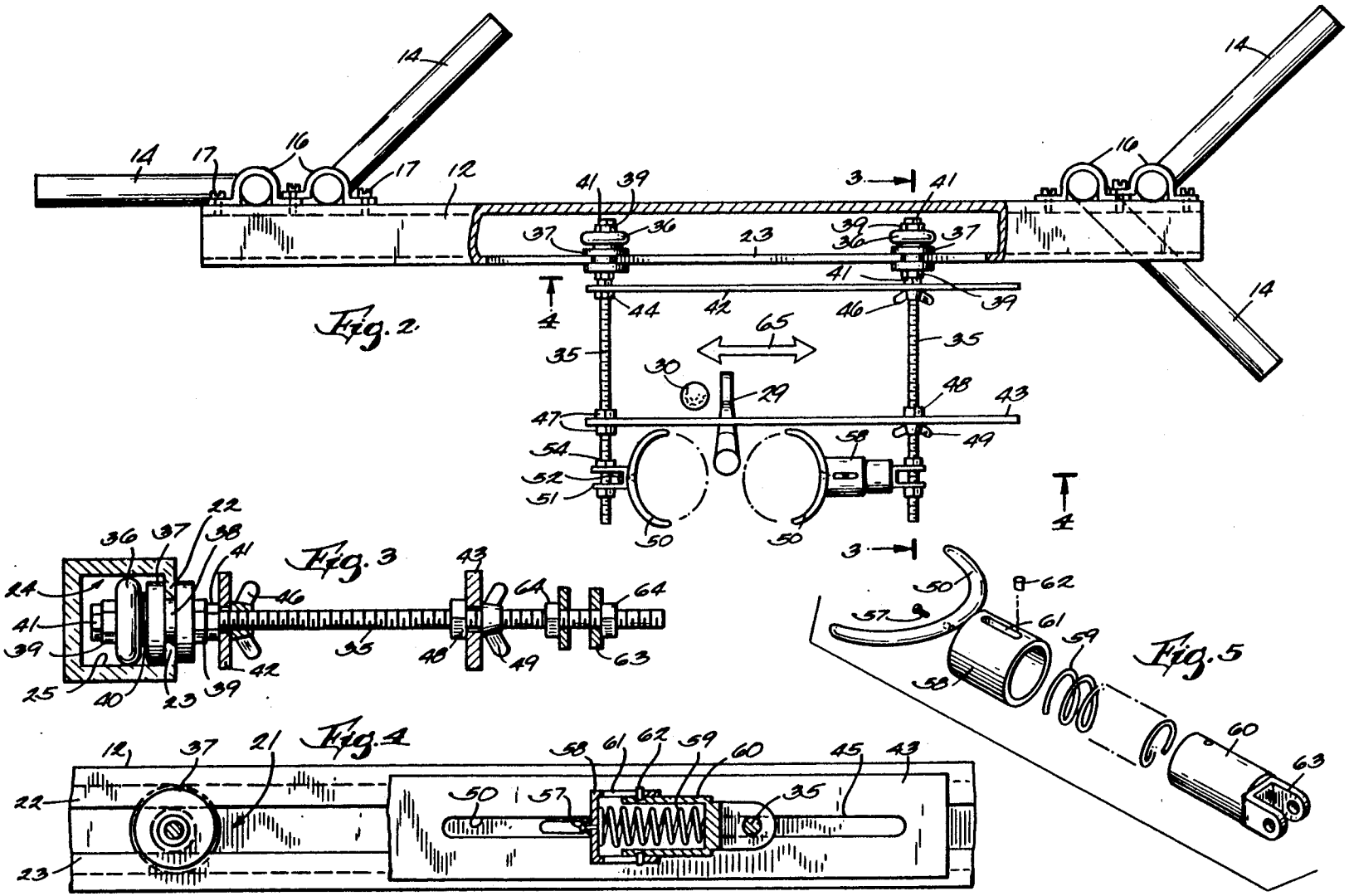
FIG. 2 is a top view of the device according to the invention.
FIG. 3 is a view taken along line 3—3 of FIG. 2.
FIG. 4 is a view taken along line 4—4 of FIG. 2.
FIG. 5 is an exploded perspective view of a guide member according to the invention.

The upper frame 12 has a hollow boxlike cross section with a longitudinal slot 21 extending for the length of the frame 12. As seen in FIGS. 1 and 3, the slot 21 results in upper and lower vertical ribs 22 and 23 which effectively form upper and lower channels 24 and 25 respectively within the frame 12. A movable carriage assembly 27 is supported by frame 12 and includes a central opening 28 through which the golfer 11 may extend his arms to grip a putter 29 while addressing a golf ball 30. The upper frame 12 may be adjusted vertically by loosening the clamps 16 and sliding the upper frame 12 and carriage assembly 27 up or down the legs 13 to suit the height of an individual user.

Details of the frame 12 and carriage assembly 27 are shown in FIGS. 2 through 5 to which reference will now be made. The carriage assembly 27 includes a pair of spaced parallel threaded cross members 35 extending outward from and perpendicular to upper frame 12. A supporting end of each cross member 35 extends through slot 21 into the interior of upper frame 12. As shown in FIGS. 2 and 3, the supporting ends of cross members 35 each have a rotatable inner wheel 36 and an outer wheel 37. The inner wheel 36 has an oval cross sectional shape while the outer wheel 37 has a generally rectangular shape with a central circumferential groove 38 formed in it. The groove 38 is of a sufficient depth to place the outer wheel 37 within the slot 21 while capturing the upper and lower ribs 22 and 23 within the groove 38. Details of the wheels 36 and 37 are not important to the invention but are of a type typically used to support shower doors or sliding closet doors. Each wheel 36 and 37 includes a stationary threaded nut portion 39 and a nonrotating washer portion 40, and as shown in FIGS. 2 and 3, the wheels are positioned with the washers 40 adjoining each other and nuts 39 are threaded onto the cross member 35. Lock nuts 41 are provided on either side of the nuts 39 to secure the wheels 36 and 37 in position on the cross member 35. The weight of the cross members 35 and associated structures which will be described hereafter cause a slight tipping so that wheel 36 rolls along the upper channel 24 while the groove 38 of wheel 37 rolls along the lower rib 23 of slot 21. The position of the central groove 38 within the slot 21 effectively prevents lateral motion of the cross member 35 relative to frame 12.

As also shown in FIGS. 2 and 3, the cross members 35 are interconnected by inner and outer spaced sidebars 42 and 43. The inner sidebar 42 at the forward cross member 35 is held in contact with the lock nuts 41 by a lock nut 44. The trailing edge of each sidebar 42 and 43 includes an elongated horizontal slot 45 through which the trailing cross member 35 extends, and a wing nut 46 holds the inner sidebar 42 securely against the lock nut 41. The outer sidebar 43 is also secured to the forward cross member 35 by means of lock nuts 47, and the trailing end is secured to the rear cross member by means of a lock nut 48 and a wing nut 49 a shown in FIGS. 2 and 3. It will thus be appreciated that by loosening the wing nuts 46 and 49 the trailing cross member 35 may be positioned within the slot 45 to vary the distance between the two cross members 35 which may then be secured in position by retightening the wing nuts 46 and 49.

Within the interior space 28 of the carriage assembly 27 and beyond outer sidebar 43, a pair of arcuate guide members 50 are provided having their concave openings facing each other between the outer ends of cross members 35. The attachment of each guide member 50 to its respective cross member 35 is shown in FIGS. 2 and 3. The forward guide member 50 is affixed to a U-shaped bracket 51 in any conventional fashion such as a countersunk screw 52 extending through the member 50 and bracket 51. The bracket 51 is configured to be adjustable axially along the forward screw member 35 with lock nuts 54 provided to secure the bracket 51 in position on the forward cross member 35.

Details of the rear guide 50 as attached to the rear cross member 35 are shown in FIGS. 2, 4 and 5. A screw 57 is used to affix the guide member 50 to a cup-like cylindrical section 58 which is open at the end opposite guide member 50 and receives a compression spring 59. A cylindrical plunger 60 is provided which compresses the spring 59 within the cylinder 58. The cylinder 58 includes a slot 61 extending in a direction parallel to the central axis of the cylinder and a dowel pin 62 is provided to ride within the slot 61 while engaging the plunger 60 to maintain it in place within the cylinder and while permitting relative motion between the plunger 60 and cylindrical section 58 during compression or extension of the spring 59. The plunger 60 also includes two brackets 63 to secure the plunger on the rearmost threaded cross member 35 with lock nuts 64 and which also permit transverse adjustment.

It will thus be appreciated that in addition to adjustability of the space between the threaded cross members 35, the outer sidebar 43 is also adjustable with respect to its spacing from the inner sidebar 42, and the guide members 50 are also laterally adjustable along the cross members 35.

Having thus described the construction of the device, its use in practice will be discussed. As shown generally in FIG. 1, a golfer 11 will position himself at the opening 28 of the carriage assembly 27 to grip a putter 29. The backs of the golfer's forearms are positioned within and against the arc of guide members 50 and the space between the forward and rearward cross members 35 is adjusted to accommodate the normal position of the golfer's arms when addressing the putt with partial compression of spring 59 resulting in light pressure of the rear guide member 50 against the golfer's arm. The carriage assembly 27 moves forward and backward during a putting stroke, and the guide members 50 will act upon the golfer's arms to force him to have a straight and true stroke parallel to the intended target line indicated by arrow 65 in FIG. 2. On the other hand, the golfer is free to grip the club and feel the putting stroke without any interference with the motion of the putter itself. Again, depending upon the particular style of a golfer, the guide members 50 may be adjusted both transversely along the cross members 35 to suit the individual as well as longitudinally by varying the distance between cross members 35 and guide members 50.

While a preferred embodiment of the invention has thus been described, it will be apparent those skilled in the art that variations in the construction and configuration of the various components of the device are possible without departing from the spirit of the invention. Accordingly the scope of the invention is to be taken solely from an interpretation of the claims which follows.

I claim:

1. A golf putting training device comprising:

a. movable carriage means for guiding the path of movement of a golfer's arms during a putting stroke;

b. said carriage means includin.g guide means for engaging the forearms of the golfer so that said cartridge means may be moved by a golfer's forearm while positioned to putt a golf ball;

c. elongated frame means for supporting said carriage means and restricting movement of said carriage means along said frame means to said path of movement during a putting stroke; and, d. leg means for supporting said frame means at a vertical elevation approximating the position of the golfer's forearms during a putting stroke.

2. A device as set forth in claim 1 wherein:

a. said frame means including a longitudinally extending channel; and, b. said carriage means having wheel means partially within said channel for supporting said carriage means and permitting said carriage to roll along said channel.

3. A device as set forth in claim 2 wherein:

a. said carriage means having a pair of spaced generally parallel cross members extending transversely to and outwardly from said frame means;

b. means for adjusting the distance between said cross members; and, c. said guide means including a separate guide member attached to each of said cross members.

4. A device as set forth in claim 3 wherein said guide means includes a pair of opposing arcuate guide members secured on said cross members and adjustable transversely.

5. A device as set forth in claim 4 wherein said carriage means having a pair of spaced sidebars interconnecting said cross members and including slot means for adjusting the distance between said cross members along said sidebars.

6. A device as set forth in claim 5 wherein said leg means include releasable clamp means for adjusting the vertical position of said frame means.

7. A device as set forth in claim 6 wherein at least one of said guide members having spring means for biasing said guide member in the direction of the opposing guide member.

8. A device as set forth in claim 3 wherein said carriage means having a pair of spaced sidebars interconnecting said cross members and including slot means for adjusting the distance between said cross members along said sidebars.

9. A device as set forth in claim 3 wherein at least one of said guide members having spring means for biasing said guide member in the direction of the opposing guide member.

10. A device as set forth in claim 1 wherein said leg means include releasable clamp means for adjusting the vertical position of said frame means.

11. A device as set forth in claim 1 wherein:

a. said carriage means having a pair of spaced generally parallel cross members extending transversely to and outwardly from said frame means;

b. means for adjusting the distance between said cross members; and, c. said guide means including a separate guide member attached to each of said cross members.

* * * * *